US007591155B2

(12) United States Patent
Chang

(10) Patent No.: US 7,591,155 B2
(45) Date of Patent: Sep. 22, 2009

(54) DRUM TYPE WASHING MACHINE

(75) Inventor: Jae Won Chang, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 842 days.

(21) Appl. No.: 10/740,575

(22) Filed: Dec. 22, 2003

(65) Prior Publication Data

US 2004/0129035 A1 Jul. 8, 2004

(30) Foreign Application Priority Data

Dec. 27, 2002 (KR) ..... 10-2002-0085519
Dec. 27, 2002 (KR) ..... 10-2002-0085520

(51) Int. Cl.
*D06F 29/00* (2006.01)
*D06F 35/00* (2006.01)

(52) U.S. Cl. ..... 68/139; 68/23 A; 68/24

(58) Field of Classification Search ..... 68/230, 68/225, 237, 142, 143, 12.26, 23 A, 139, 68/23 R See application file for complete search history.

(56) References Cited

U.S. PATENT DOCUMENTS

| | | | | |
|---|---|---|---|---|
| 1,657,181 | A | 1/1928 | Sando | |
| 3,089,326 | A | 5/1963 | Belaieff | |
| 3,531,954 | A * | 10/1970 | Krupsky | 68/18 F |
| 3,783,653 | A * | 1/1974 | Haerick | 68/145 |
| 4,618,193 | A * | 10/1986 | Cuthbert et al. | 312/264 |
| 4,771,253 | A * | 9/1988 | Sasaki et al. | 335/17 |
| 5,678,430 | A * | 10/1997 | Merlin et al. | 68/24 |
| 7,117,613 | B2 * | 10/2006 | Guinibert et al. | 34/534 |
| 2002/0014095 | A1 * | 2/2002 | Seagar et al. | 68/142 |

FOREIGN PATENT DOCUMENTS

| | | | |
|---|---|---|---|
| CN | 2423308 | Y | 3/2001 |
| CN | 1332816 | A | 1/2002 |
| DE | 1188547 | B | 3/1965 |
| DE | 4426900 | A1 | 2/1995 |
| DE | 19806884 | A1 | 8/1999 |
| EP | 0 869 212 | A | 10/1998 |
| EP | 0 869 212 | A2 | 10/1998 |
| EP | 0 943 720 | A1 | 9/1999 |
| FR | 2478151 | A | 9/1981 |
| GB | 1 353 283 | A | 5/1974 |
| JP | 39-21844 | U | 7/1962 |
| JP | 49-135264 | U | 11/1974 |

(Continued)

*Primary Examiner*—Michael Barr
*Assistant Examiner*—Rita R Patel
(74) *Attorney, Agent, or Firm*—Birch, Stewart, Kolasch & Birch, LLP

(57) ABSTRACT

A drum type washing machine comprises: a cabinet forming an outer appearance of the washing machine; a tub fixed inside the cabinet for storing the washing water; a drum disposed in the tub and having both side surfaces supported by the cabinet to be rotatable and an inlet through which laundries come in/go out on a circumferential surface thereof; and a driving motor fixed on one side surface of the drum to rotate the drum. Therefore, washing capacity can be increased as maintaining entire size of the washing machine by increasing a diameter of the drum without increasing size of the cabinet, and entire size of the washing machine can be compacted by minimizing installation space of the driving motor.

12 Claims, 16 Drawing Sheets

FOREIGN PATENT DOCUMENTS

| | | | |
|---|---|---|---|
| JP | 63-95587 | U | 6/1988 |
| JP | 01-230390 | A | 9/1989 |
| JP | 02-189188 | A | 7/1990 |
| JP | 09-066185 | A | 3/1997 |
| JP | 2002-529173 | T | 9/2002 |

* cited by examiner

DRUM TYPE WASHING MACHINE

This Nonprovisional application claims priority under 35 U.S.C. § 119(a) on Patent Application No(s). 10-2002-0085519 and 10-2002-0085520 filed in Korea on Dec. 27, 2002, the entire contents of which are hereby incorporated by reference.

BACKGROUND OF THE INVENTION

1. Field of the Invention

The present invention relates to a drum type washing machine, and particularly, to a drum type washing machine which is able to maximize washing capacity without changing entire size of the washing machine.

2. Description of the Background Art

FIG. 1 is a cross-sectional view showing a drum type washing machine according to the conventional art, and FIG. 2 is a front view showing the drum type washing machine according to the conventional art.

The drum type washing machine according to the conventional art comprises: a cabinet 102 forming an outer appearance of the washing machine; a tub 104 disposed inside the cabinet 102 for storing washing water; a drum 106 disposed inside the tub 104 to be rotatable for washing and drying laundries; and a driving motor 110 located on a rear portion of the tube 104 and connected with the drum 106 through a driving axis 108 for rotating the drum 106.

An inlet 112 is formed on a front portion of the cabinet 102 so as to put or to draw the laundries, and a door 114 is disposed on a front portion of the inlet 112.

The tub 104 is a cylindrical shape having an opening 116 on the front portion thereof so as to be communicated with the inlet 112 of the cabinet 102, and a diameter of the tub 104 is designed to be 30~40 mm shorter than a width of the cabinet 102 so as to prevent from contacting to the cabinet 102 in drying process.

The drum 106 is a cylinder shape with an opened end so that the laundries can be put/drawn. In addition, since the drum 106 is rotated in the tub 104, a diameter 106 is designed to be 15~20 mm shorter than that of the tub 104 in order to prevent interruption between the tub 104.

A plurality of supporting springs 120 are installed between an upper part of the tub 104 and an inner upper wall of the cabinet 102, and a plurality of dampers 122 are installed between a lower part of the tub 104 and an inner lower wall of the cabinet 102 to support the tub 104 so as to buff the shock.

A gasket 124 is installed between the inlet 112 of the cabinet 102 and the opening 116 of the tub 104 in order to prevent the washing water stored in the tub 104 from being leaked into the space between the tub 104 and the cabinet 102. In addition, a supporting frame 126 where the driving motor 110 is mounted is installed on a rear portion of the tub 104.

The driving motor 110 is fixed on a rear surface of the supporting frame 126, and the driving axis 108 of the driving motor 110 is fixed on a lower surface of the drum 106 to generate the driving force for rotating the drum 106.

In the drum type washing machine according to the conventional art, the diameter of the tub 104 is designed as considering maximum vibration width of the tub 104 in the cabinet 102 for preventing the tub 104 from contacting to the cabinet 102, and the diameter of the drum 106 is also designed to be shorter than the diameter of the tub 104 in order to prevent the interruption between the tub 104 since the drum 106 is rotated in the tub 104. Therefore, in order to increase the diameter of the drum 106 which is directly related to the washing capacity, the size of the cabinet 102 should be increased.

Also, the gasket 124 for preventing the washing water from being leaked is installed between the inlet 112 of the cabinet 102 and the opening 116 of the tub 104, and therefore, the length of the drum 106 is reduced as much as the length of the gasket 124. Therefore, it is difficult to increase the capacity of the drum 106.

SUMMARY OF THE INVENTION

Therefore, an object of the present invention is to provide a drum type washing machine which is able to increase washing capacity without increasing entire size of a washing machine by forming a cabinet and a tub integrally in order to increase a diameter of the drum without increasing a size of the cabinet.

Another object of the present invention is to provide a drum type washing machine which is able to compact entire size of the washing machine while increasing washing capacity by minimizing installation space of a driving motor.

Also, another object of the present invention is to provide a drum type washing machine in which a drum rotates more stably in washing and drying processes by supporting both sides of the drum to be rotatable.

Still another object of the present invention is to provide a drum type washing machine which is able to increase convenience in using the washing machine by making a drum door opening/closing a drum operated automatically.

To achieve these objects of the present invention, as embodied and broadly described herein, there is provided a drum type washing machine according to the present invention comprising: a cabinet making an outer appearance of the washing machine; a tub fixed inside of the cabinet for storing washing water; a drum disposed in the tub, having both side surfaces supported by the cabinet to be rotatable and an inlet, through which laundries are put/drawn, formed on a circumferential surface thereof; and a driving motor fixed on one side surface of the drum for generating driving force which rotates the drum.

The tub is formed as a cylinder having a front portion formed integrally on a front inner wall of the cabinet and a rear portion formed integrally on a rear inner wall of the cabinet.

The tub comprises: a first separating wall portion integrally fixed between upper front inner wall of the cabinet and a rear inner wall of the cabinet; and a second separating wall portion fixed integrally on a lower front inner wall and the rear inner wall of the cabinet and formed as a curved surface.

Penetrating holes are formed on both side surfaces of the tub, and a first and second supporting frames having shorter diameters than those of the penetrating holes are located on both side surface of the tube. In addition, gaskets are installed between an inner circumferential surface of the penetrating hole and outer circumferential surfaces of the first and second supporting frames respectively.

The driving motor comprises: a rotor fixed on a side surface of the drum and a stator located on an inner circumferential surface of the rotor to interact with the rotor. In addition, the rotor is formed integrally with the driving axis and fixed on the side surface of the drum, and a magnet is mounted on the inner circumferential surface thereof.

A drum door is installed on an inlet of the drum for opening/closing the inlet, and guide rails for guiding the drum door so as to be moved are formed on both side surfaces of the drum inlet to be a predetermined length.

A locking system for locking the drum door is installed on the drum door, and the locking system comprises: a housing fixed on the front portion of the drum door so as to have a predetermined space; a locking rod inserted into the housing to be moved in up-and-down direction; a spring disposed between a stopper fixed on one side of the locking rod and an inner wall of the housing for granting a predetermined elastic force to the locking rod; and a locking hole, in which the locking rod is inserted, formed on one side of the drum inlet.

Also, there is provided a drum type washing machine comprising: a cabinet forming an outer appearance; a tub fixed in the cabinet for storing washing water; a drum disposed in the tub, having both side surfaces supported by the cabinet to be rotatable and an inlet, through which laundries are put/drawn, formed on a circumferential surface thereof; a drum door installed on the inlet of the drum for opening/closing the drum inlet; and a door opening/closing device for automatically opening/closing the drum door.

The door opening/closing device comprises a suspending rod connected to an end portion of a hinge shaft of the door; an actuator mounted on one side of the suspending rod for restricting the rotation of the suspending rod; and a controlling means for driving the actuator and rotating the drum for opening/closing the drum door.

The controlling means comprises: a drum location detecting device for detecting the location of the drum; and a control unit for driving the driving motor and the actuator according to a signal applied from the drum location detecting device.

A backspin preventing means is installed on the door hinge shaft for preventing the drum door from rotating toward the opening direction, and the backspin preventing means is a backspin preventing spring wound on the door hinge shaft having one end portion fixed on a hinge shaft supporting the drum and the other end portion extended to be a predetermined length along with the suspending rod.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
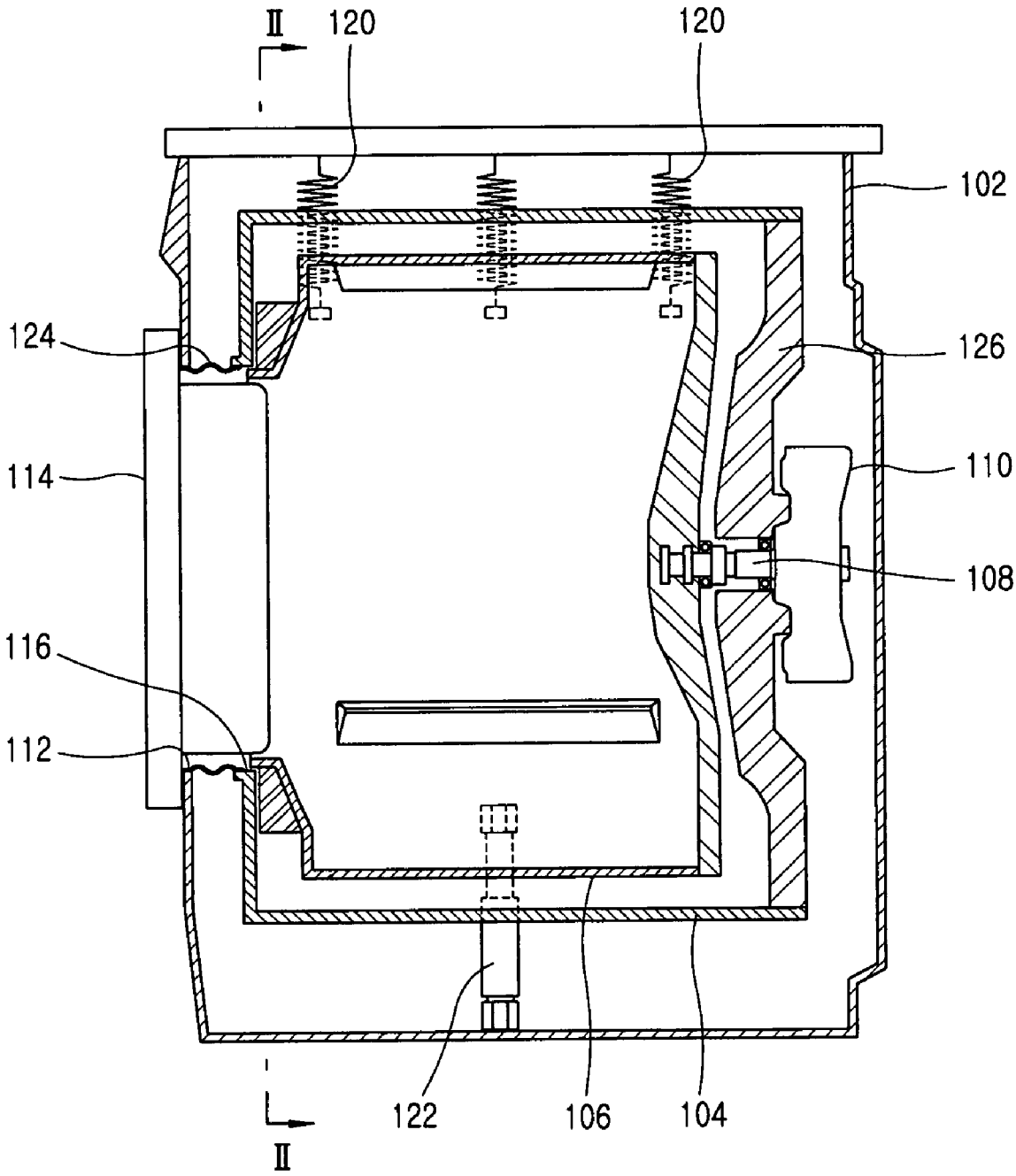
FIG. 1 CONVENTIONAL ART
FIG. 1 is a cross-sectional view showing a drum type washing machine according to the conventional art.
Figure 2:
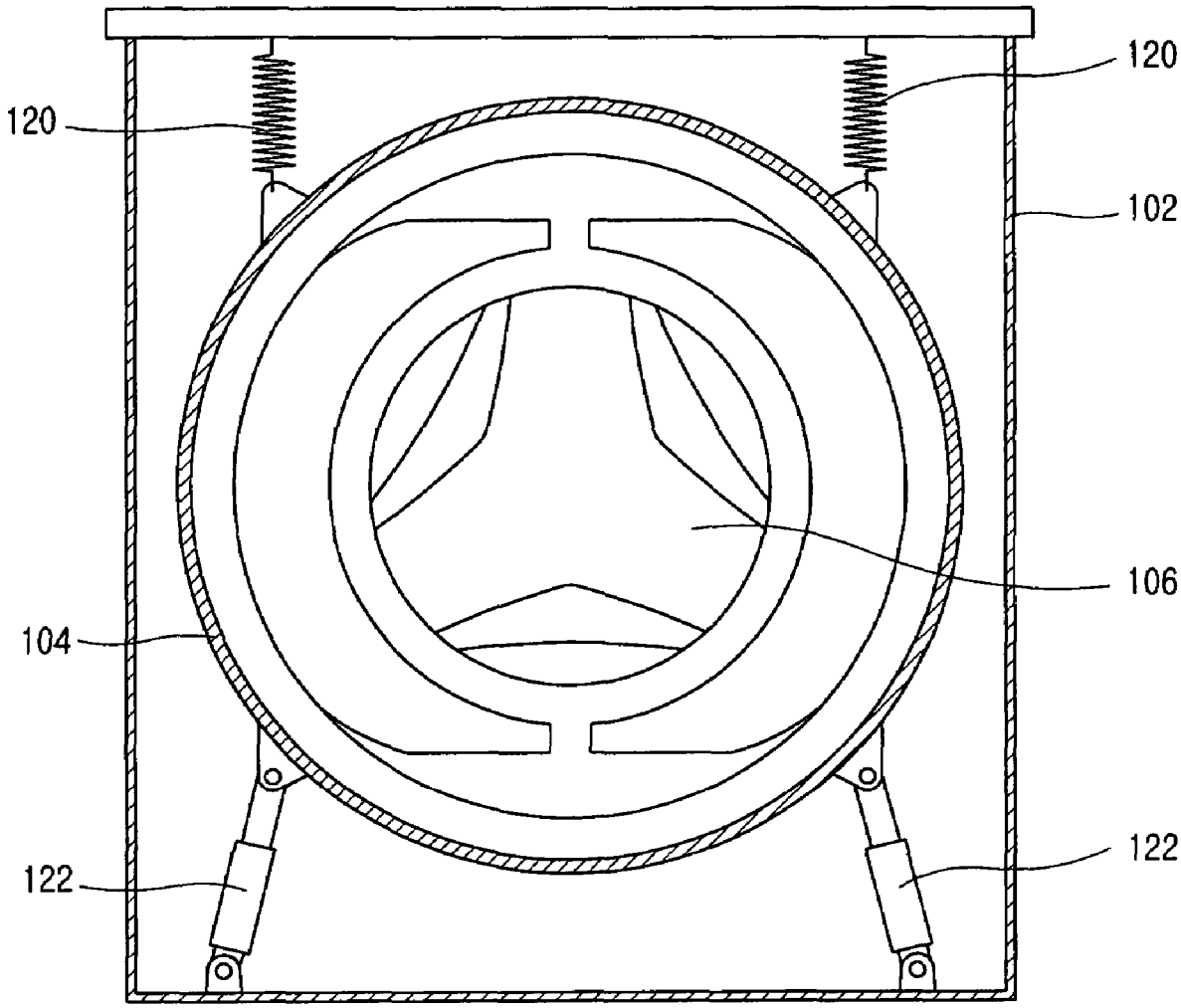
FIG. 2 CONVENTIONAL ART
FIG. 2 is a cross-sectional view in line II-II direction in FIG. 1.
Figure 3:
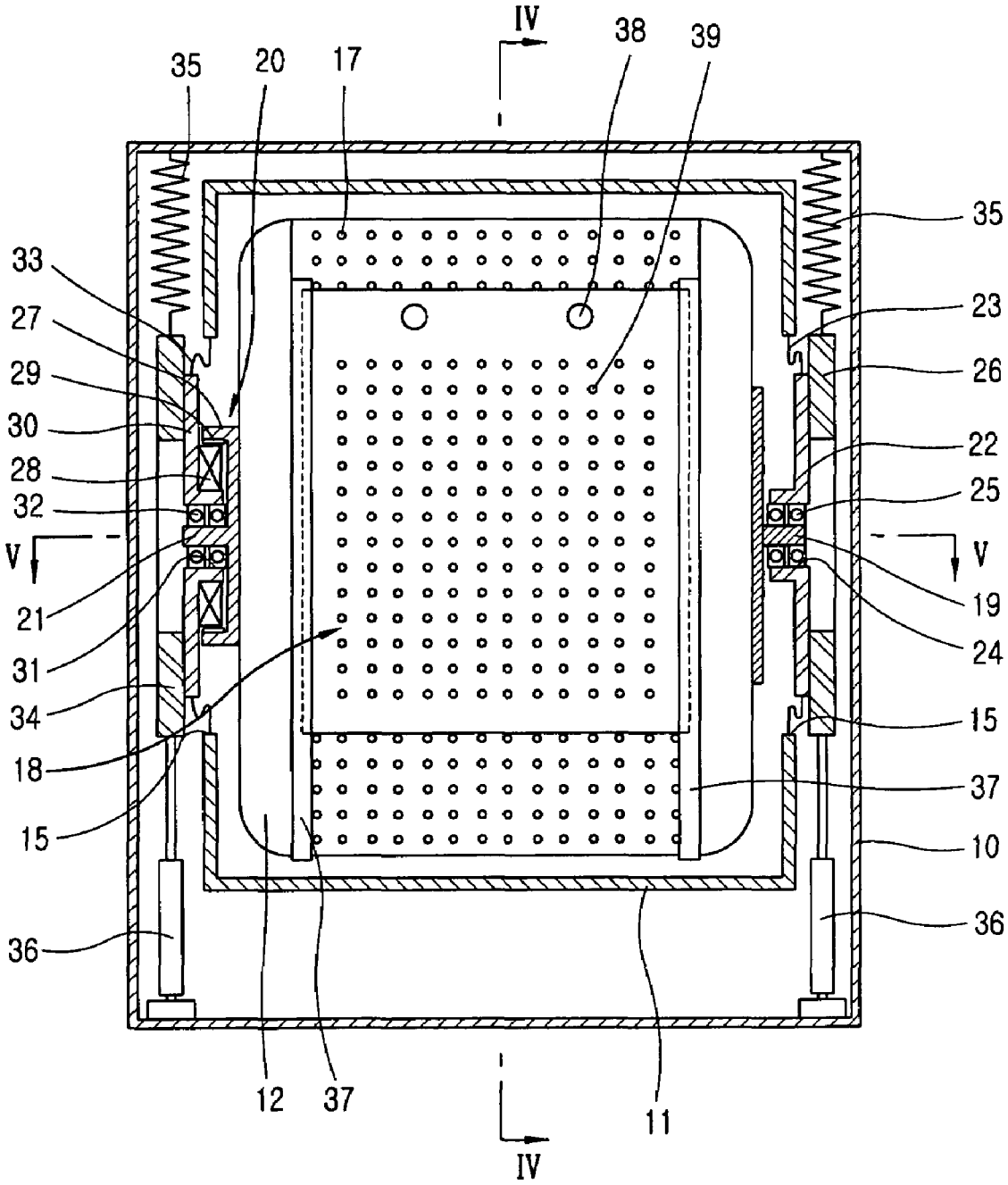
FIG. 3 is a cross-sectional view showing a drum type washing machine according to an embodiment of the present invention.
Figure 4:
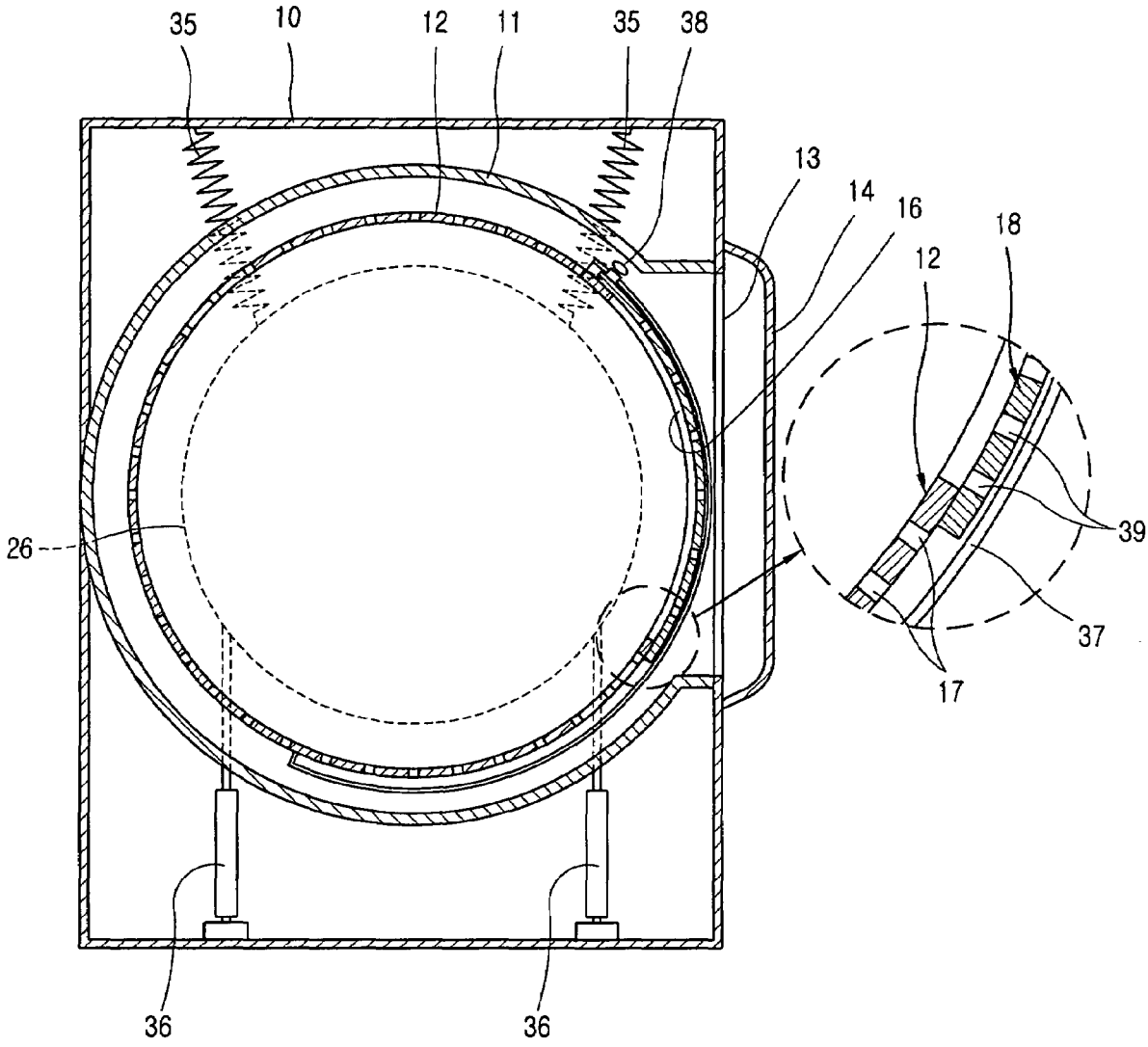
FIG. 4 is a cross-sectional view in line IV-IV direction shown in FIG. 3.
Figure 5:
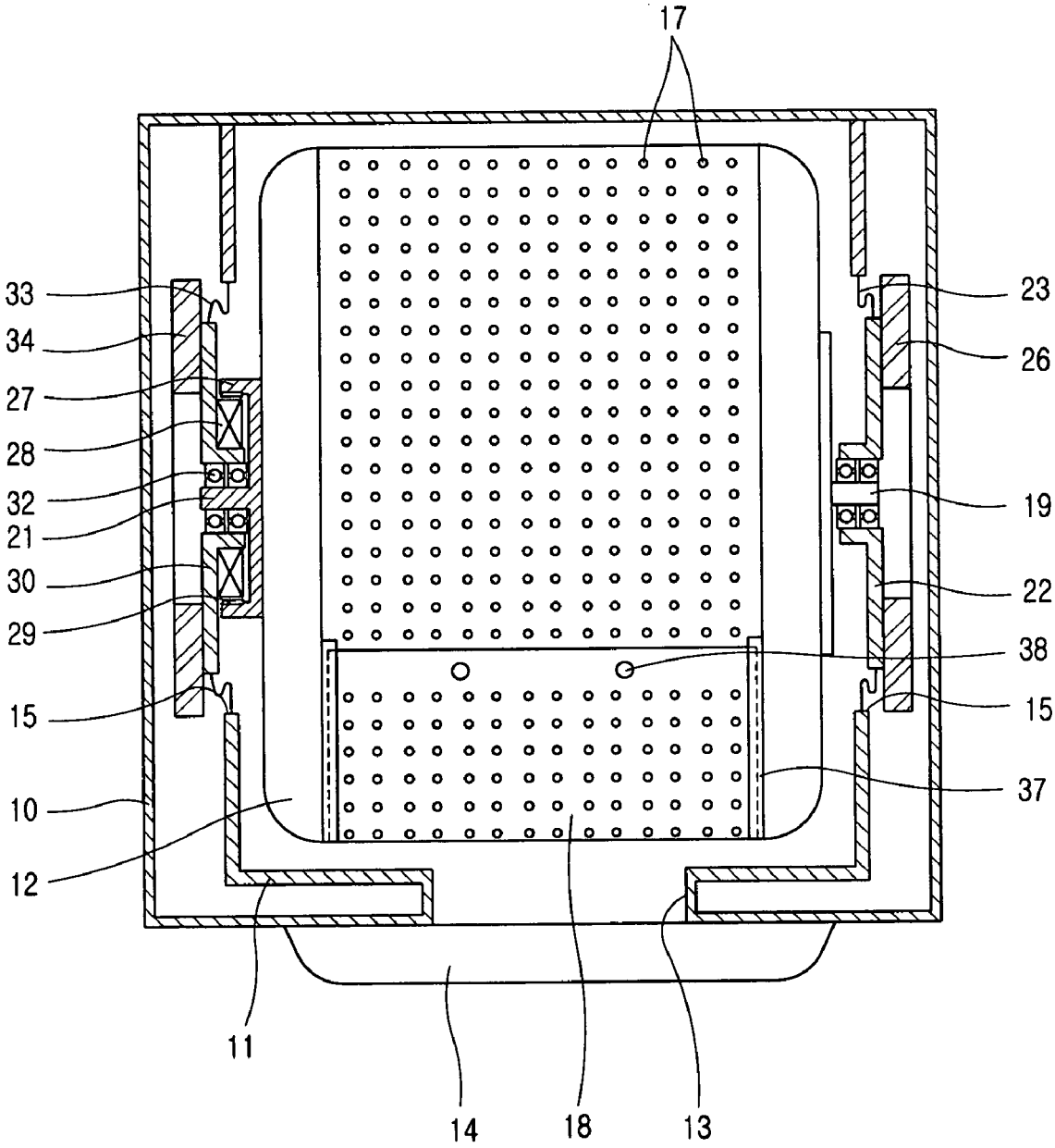
FIG. 5 is a cross-sectional view in line V-V direction shown in FIG. 3.

FIG. 3 is a cross-sectional view showing a drum type washing machine according to an embodiment of the present invention, FIG. 4 is a cross-sectional view in line IV-IV direction in FIG. 3, and FIG. 5 is a cross-sectional view in line V-V direction in FIG. 3.

The drum type washing machine according to the embodiment of the present invention comprises: a cabinet 10 forming an outer appearance of the washing machine; a tub 11 formed integrally with the cabinet 10 for storing washing water; and a drum 12 disposed in the tub 11 to be rotatable for washing and drying laundries.

The cabinet 10 is formed as a rectangle having an inlet 13 through which the laundries are put/drawn formed on a front portion thereof and a cabinet door 14 for opening/closing the inlet 13 formed on the inlet 13.

The tub 11 is formed as a cylinder disposed in the cabinet 10. In addition, a front portion of the tub 11 is fixed or integrally formed on a boundary surface of the inlet 13 of the cabinet 10 as opened status, and a rear portion of the tub 11 is fixed or integrally formed on a rear surface of the cabinet 10. And penetrating holes 15 of circular shape having a predetermined diameter respectively are formed on both planes of the tub 11.

The drum 12 is a cylinder having shorter diameter than that of the tub 11 and disposed in the tub 11 to be rotatable. In addition, a plurality of washing water holes 17 through which the washing water goes in/out are formed on boundary direction of the drum 12, and both side surfaces of the drum 12 are sealed respectively. In addition, an inlet 16 through which the laundries can be put/drawn in order to receive the laundries in the drum 12 is formed on a circumferential surface of the drum 12, and a drum door 18 for opening/closing the inlet 16 is installed on the inlet 16 of the drum to be opened/closed.

A hinge shaft 19 for supporting the drum 12 to be rotatable is fixed on a center of one side surface of the drum 12, and a driving axis 21 for rotating the drum 12 by connecting with a driving motor 20 is fixed on a center of the other side surface of the drum 12.

The hinge shaft 19 is fixed on the center of one side surface of the drum 12 which is formed as a plane shape and is supported by a first supporting frame 22 to be rotatable. Herein, the first supporting frame 22 is formed as a disc having a predetermined diameter and a supporting hole 24 penetrated a center thereof so that the hinge shaft 19 can be inserted therein. In addition, a first gasket 23 for preventing the washing water filled in the tub 11 from being leaked to outside of the tub 11 is installed between an outer circumferential surface of the first supporting frame 22 and an inner circumferential surface of the penetrating hole 15 of the tub 11.

Herein, a bearing 25 for supporting the hinge shaft 19 so as to be rotatable is installed between the inner circumferential surface of the supporting hole 24 on the first supporting frame 22 and the outer circumferential surface of the hinge shaft 19, and a first reinforcing plate 26 for reinforcing the supporting frame 22 is mounted on a rear surface of the first supporting frame 22.

The first gasket 23 is formed as a folded ring type having a predetermined width.

The driving motor 20 comprises: a rotor 27 formed integrally with the driving axis 21 and fixed on the other side surface of the drum 12; and a stator 28 located on the inner circumferential surface of the rotor 27 with a predetermined gap from the rotor 27 and rotating the rotor 27 by interacting with the rotor 27 when the power source is applied.

Herein, the rotor 27 has a front surface fixed on the center of the other side surface of the drum 12, and a magnet 29 is mounted on inner surface boundary direction of the rotor 27.

The driving axis 21 is supported by a second supporting frame 30 to be rotatable, and the second supporting frame 30 is formed as a disc having a predetermined diameter. In addition, a bearing 32 for supporting the driving axis 21 to be rotatable is mounted between an inner circumferential surface of the supporting hole 31 formed on the center portion of the second supporting frame 30 and an outer circumferential surface of the driving axis 21, and the stator 28 is fixed on the front surface of the second supporting frame 30.

In addition, a second gasket 33 for preventing the washing water filled in the tub 11 from being leaked is mounted between the outer circumferential surface of the second supporting frame 30 and the inner circumferential surface of the penetrating hole 15 of the tub 11, and a second reinforcing plate 34 for reinforcing the second supporting frame 30 is mounted on a rear surface of the second supporting frame.

Herein, the second gasket 33 has same shape as that of the first gasket 23.

Buffing springs 35 for absorbing the shock generated when the drum 12 is rotated are installed between the first and second reinforcing plates 26 and 34 and upper inner wall of the cabinet 10, and dampers 36 for absorbing vibration are installed between the first and second reinforcing plates 26 and 34 and the lower inner wall of the cabinet 10.

That is, the hinge shaft 19 and the driving axis 21 which are fixed on the drum 12 are supported respectively on the first and second supporting plates 26 and 34, and thereby, the vibration generated due to the rotation of the drum 12 is softened and absorbed by the buffing springs 35 and the dampers 36.

Figure 6:
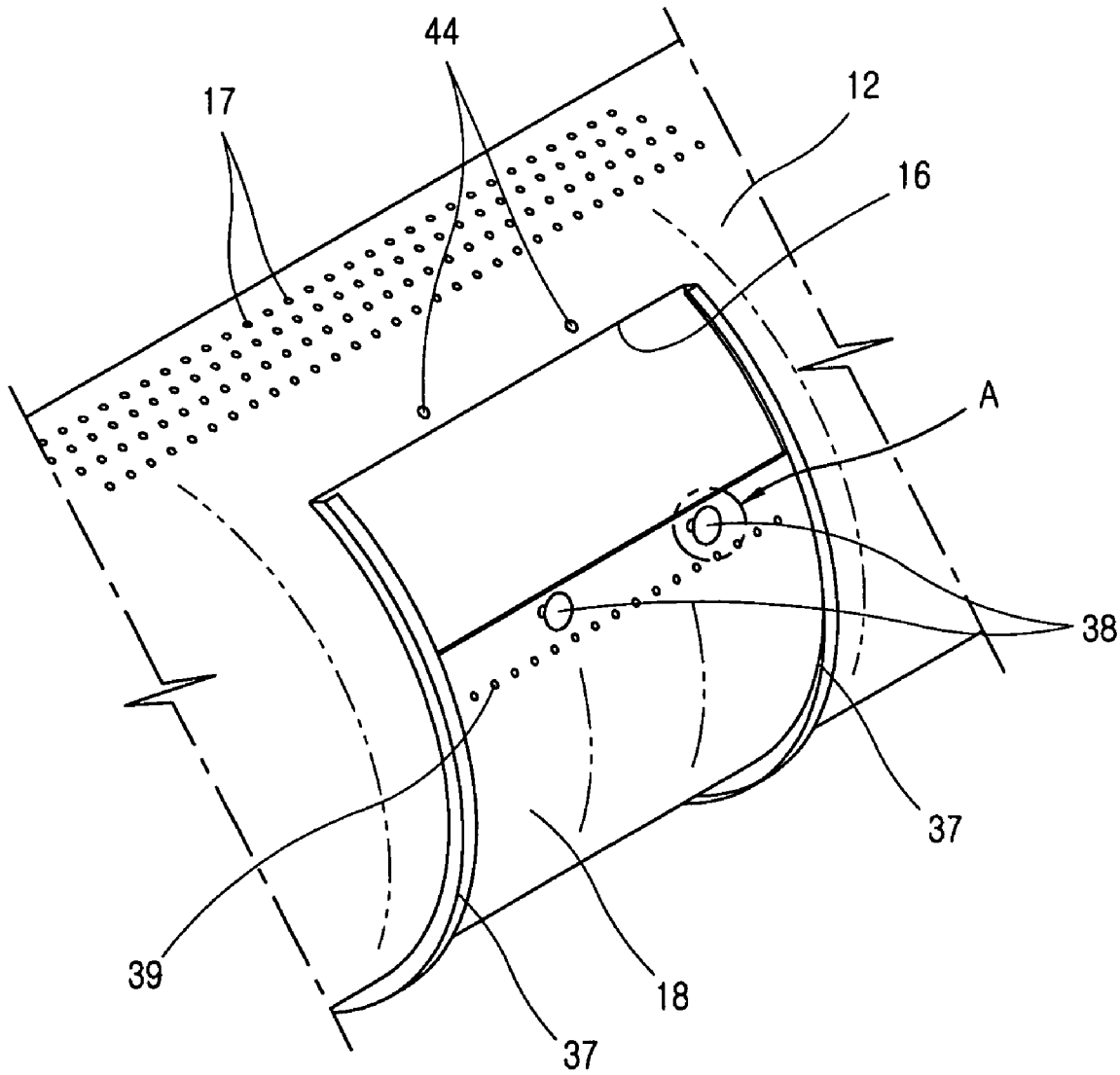
FIG. 6 is a partial perspective view showing a drum cover of the drum type washing machine according to the embodiment of the present invention.

FIG. 6 is a partial perspective view showing a drum door of the drum type washing machine according to the present invention.

Guide rails 37 are installed on both sides of the inlet 16 of the drum 12 for guiding the drum door 18 by a predetermined length toward the circumferential direction, and the drum door 18 is a plate type having same curvature as that of the circumferential surface of the drum 12 and having a plurality of washing water in/out holes 39. In addition, both side surfaces of the door 18 are inserted in the guide rails 37 and moved along with the guide rails 37 to open/close the inlet 16 of the drum 12.

Herein, a door handle 38 for the user to open/close manually is installed on one side of the drum door 18, and a locking device for locking the drum door 18 after closing the drum door 18 is installed on the door handle 38.

Figure 7:
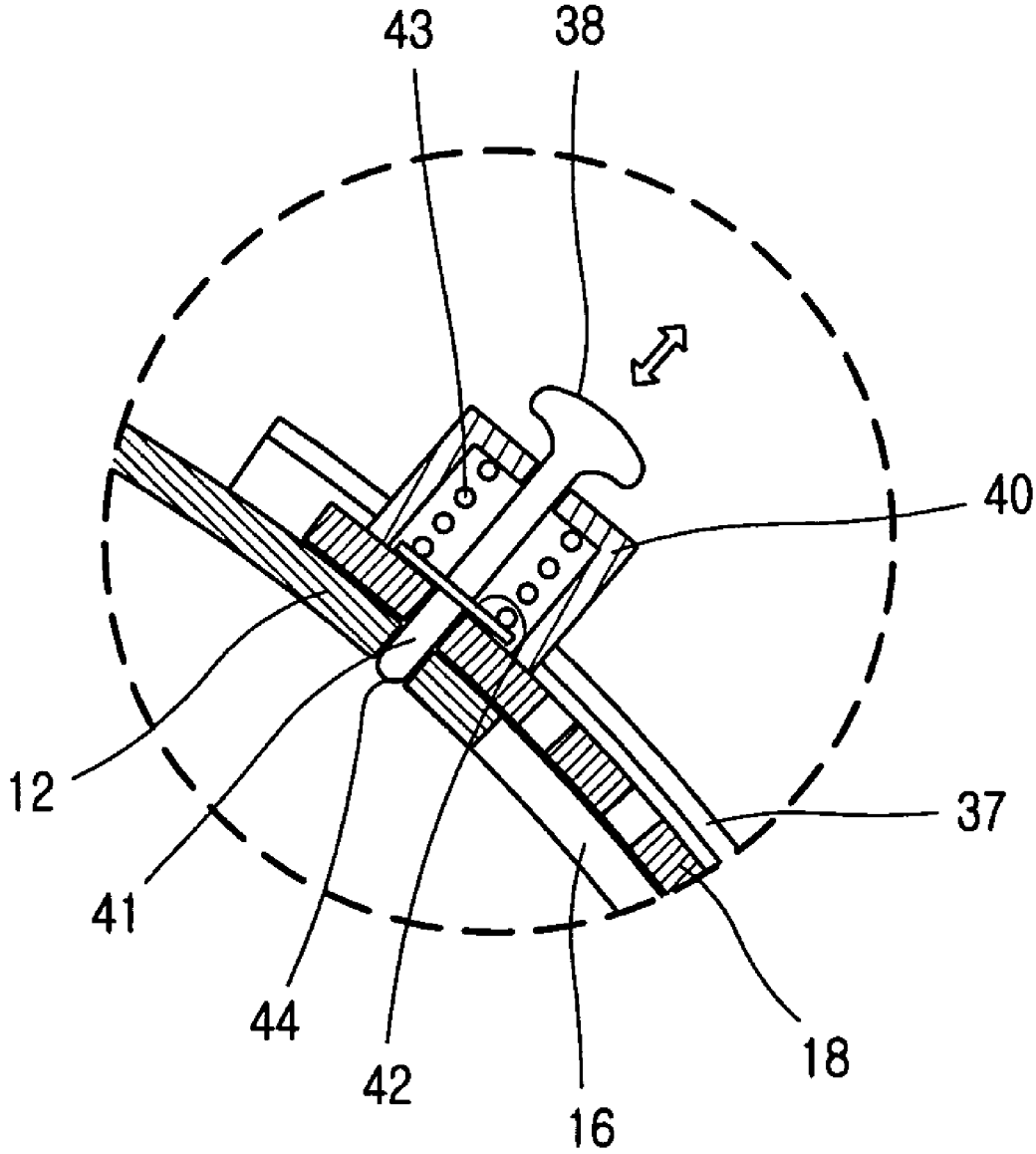
FIG. 7 is an enlarged cross-sectional view showing A part of FIG. 6.

As shown in FIG. 7, the locking device comprises: a housing 40 fixed on front end portion of the drum door 18 to have a predetermined space; a locking rod 41 inserted into the housing 40 to be reciprocated in up-and-down direction and formed integrally with the door handle 38; a spring 43 disposed between a stopper 42 fixed on one side of the locking rod 41 and the inner wall of the housing 40 for granting a certain elastic force to the locking rod 41; and a locking hole 44 formed on one side of the inlet 16 of the drum 12 so that the locking rod 41 is inserted therein.

That is, in the above locking device, when the user pulls the door handle 38, the locking rod 41 formed integrally with the door handle 38 is moved upward due to the elastic force of the spring 43. And when the user releases the handle after closing the drum door 18 in above status, the locking rod 41 is inserted into the locking hole 44 formed on the drum 12 by the elastic force of the spring to prevent the drum door 18 from being opened.

Operations of the drum type washing machine constructed as above according to the present invention will be described as follows.

The laundries are put into the drum 12 after opening the cabinet door 14 and the drum door 18, and then, the drum door 18 and the cabinet door 14 are closed. That is, the door handle 38 is moved toward the closing direction of the inlet 16 of the drum 12 as holding the door handle 38, and after that, the lock rod 41 is set to be located on the locking hole 44 by pulling the door handle 38 upward and the door handle 38 is released. Then, the locking rod 41 is inserted into the locking hole 44 by the elastic force of the spring 43 and the closed status of the drum door 18 is maintained.

In above status, when a power switch is turned on, the washing water is induced into the tub 11. At that time, the front and rear portions of the tub 11 are integrally fixed on the cabinet 10 respectively, and the penetrating holes 15 formed on both side surfaces are connected to the first and second supporting frames 22 and 30 by the gaskets 23 and 33, and thereby, the washing water induced into the tub 11 is not leaked to outside.

When the inducing of washing water is completed, the driving motor 20 is operated to rotate the drum 12 and perform the washing and drying processes.

Herein, the both side surfaces of the drum 12 are supported by the hinge shaft 19 and by the driving axis 21 to be rotatable, and therefore, the drum 12 rotated more stably. In addition, the shock and vibration generated when the drum 12 is rotated is buffed by the buffing spring 35 and the damper 36 disposed between the first and second reinforcing plates 26 and 34 fixed on the first and second supporting frames 22 and 30 supporting the hinge shaft 19 and the driving axis 21 and the cabinet 10.

In addition, when the power source is applied to the stator 28 of the driving motor 20, the rotor 27 fixed on the surface of the drum 12 is rotated to rotate the drum 12.

At that time, since the rotor 27 is fixed on the side surface of the drum 12, the space where the driving motor 20 is installed can be reduced greatly.

Figure 8:
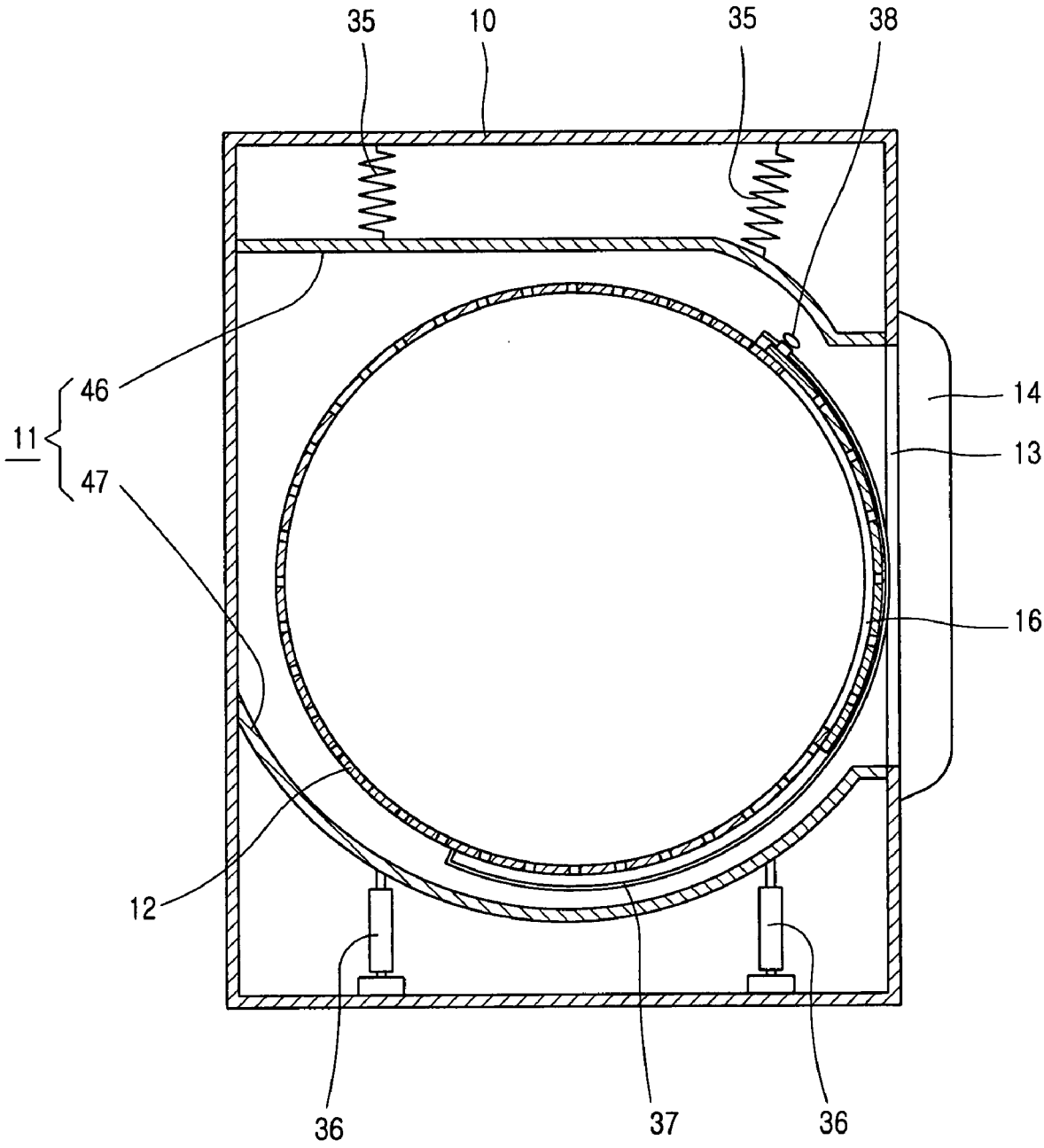
FIG. 8 is a cross-sectional view showing a drum type washing machine according to a second embodiment of the present invention.

FIG. 8 is a cross-sectional view showing a drum type washing machine according to a second embodiment of the present invention.

The drum type washing machine according to the second embodiment has same structures and operations as those of the above embodiment except the tub 11.

That is, the tub 11 according to the second embodiment comprises: a first separating wall portion 46 integrally fixed between upper front wall and rear inner wall of the cabinet 10 and straightly formed; and a second separating wall portion 47 integrally fixed on the lower front inner wall and the rear inner wall of the cabinet 10 and formed as a curved plate.

Figure 9:
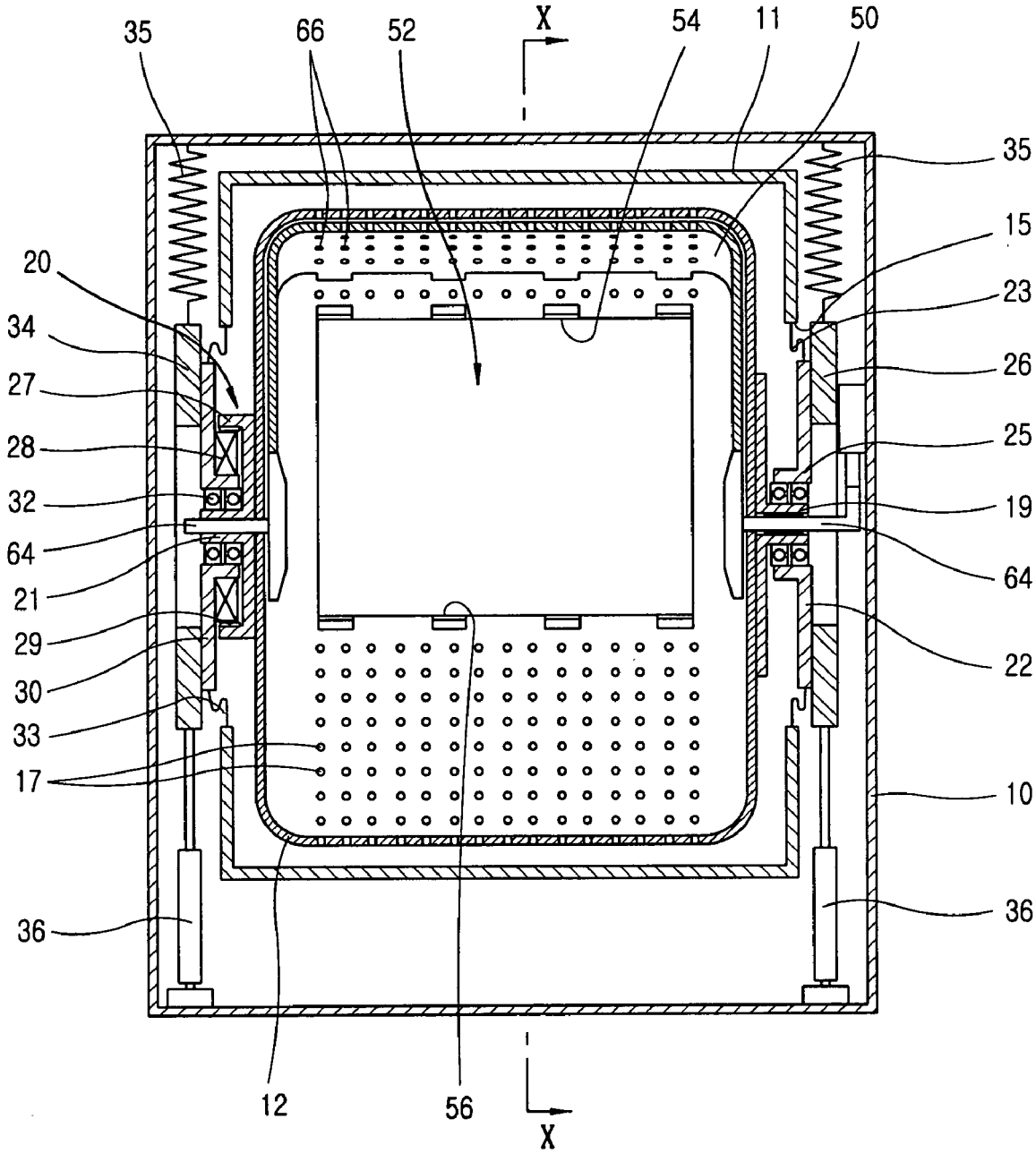
FIG. 9 is a cross-sectional view showing a drum type washing machine according to a third embodiment of the present invention.
Figure 10:
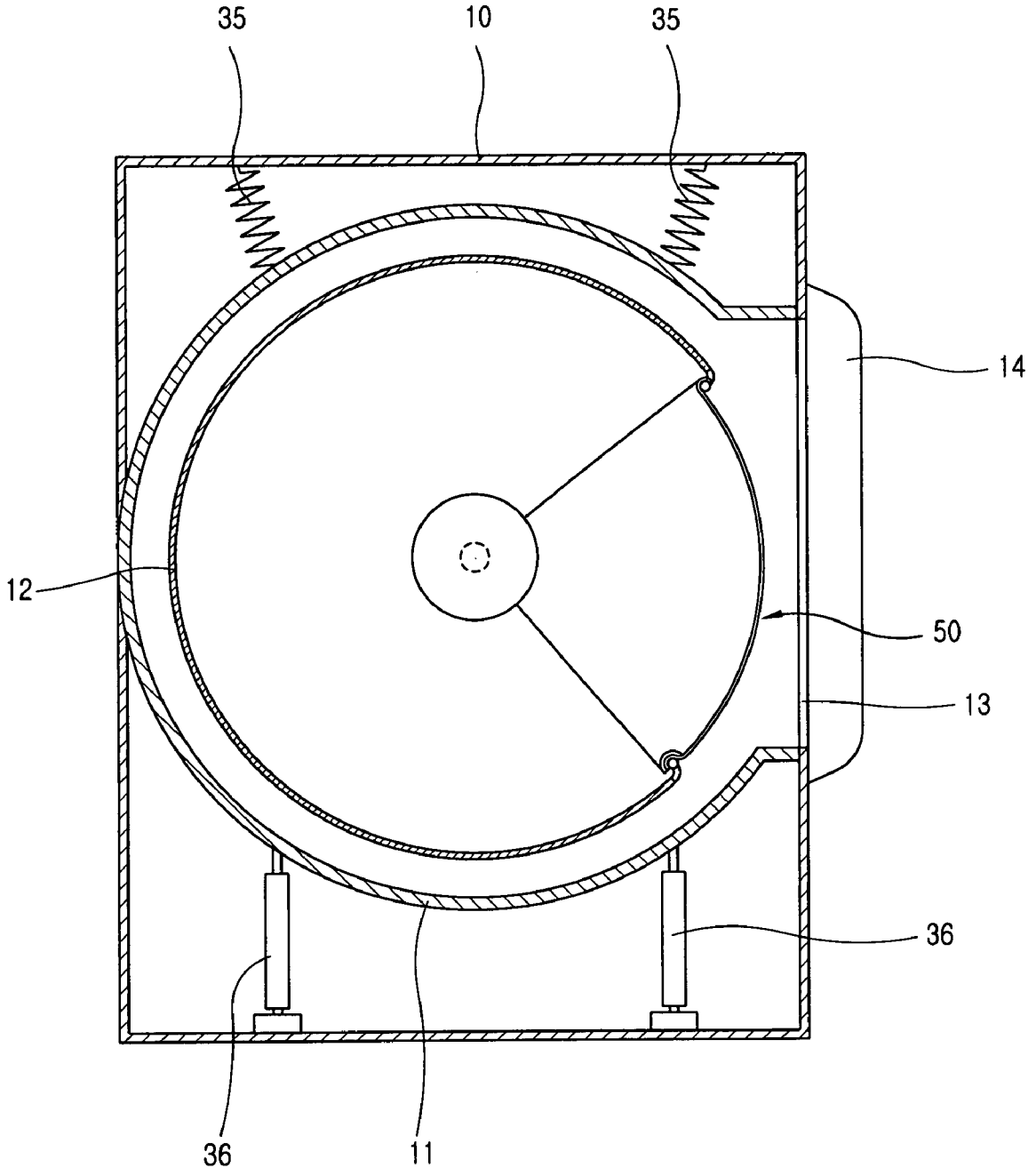
FIG. 10 is a cross-sectional view in line X-X direction in FIG. 9.

FIG. 9 is a cross-sectional view showing a drum type washing machine according to a third embodiment of the present invention, and FIG. 10 is a cross-sectional view in line X-X direction in FIG. 9.

The drum type washing machine according to the third embodiment comprises: a cabinet 10 forming an outer appearance of the washing machine; a tub 11 formed integrally with the cabinet 10 for storing washing water; a drum 12 disposed in the tub 11 to be rotatable for washing and drying the laundries; a drum door 50 formed on a circumferential surface of the drum 12 for opening/closing an inlet through which the laundries come in/go out; and a door opening/closing device for opening/closing the drum door 50 automatically.

The cabinet 10 and the tub 11 have same structures and operations as those of the above embodiment, and therefore, descriptions for those will be omitted.

The drum 12 according to the third embodiment is formed as a cylinder having shorter diameter than that of the tub 11 and both side surfaces sealed. In addition the hinge shaft 19 for supporting the drum 12 to be rotatable is fixed on a center of one side surface, and the rotor 27 of the driving motor 20 rotating the drum 12 is fixed on a center of the other side surface.

In addition, an inlet 52 through which the laundries come in/go out is formed on the circumferential surface of the drum 12 in order to put the laundries into the drum 12, and the drum door 50 for opening/closing the inlet 52 is installed on the inlet 52 of the drum 12 to be opened/closed.

Herein, a plurality of suspending rods 54 for preventing the drum door 50 from moving more than a predetermined degree by suspending the drum door 50 are installed on one end portion of the drum inlet 52, and a plurality of locking rods 56 for locking the closed status of the drum door 50 are formed on the other end portion of the drum inlet 52.

Figure 11:
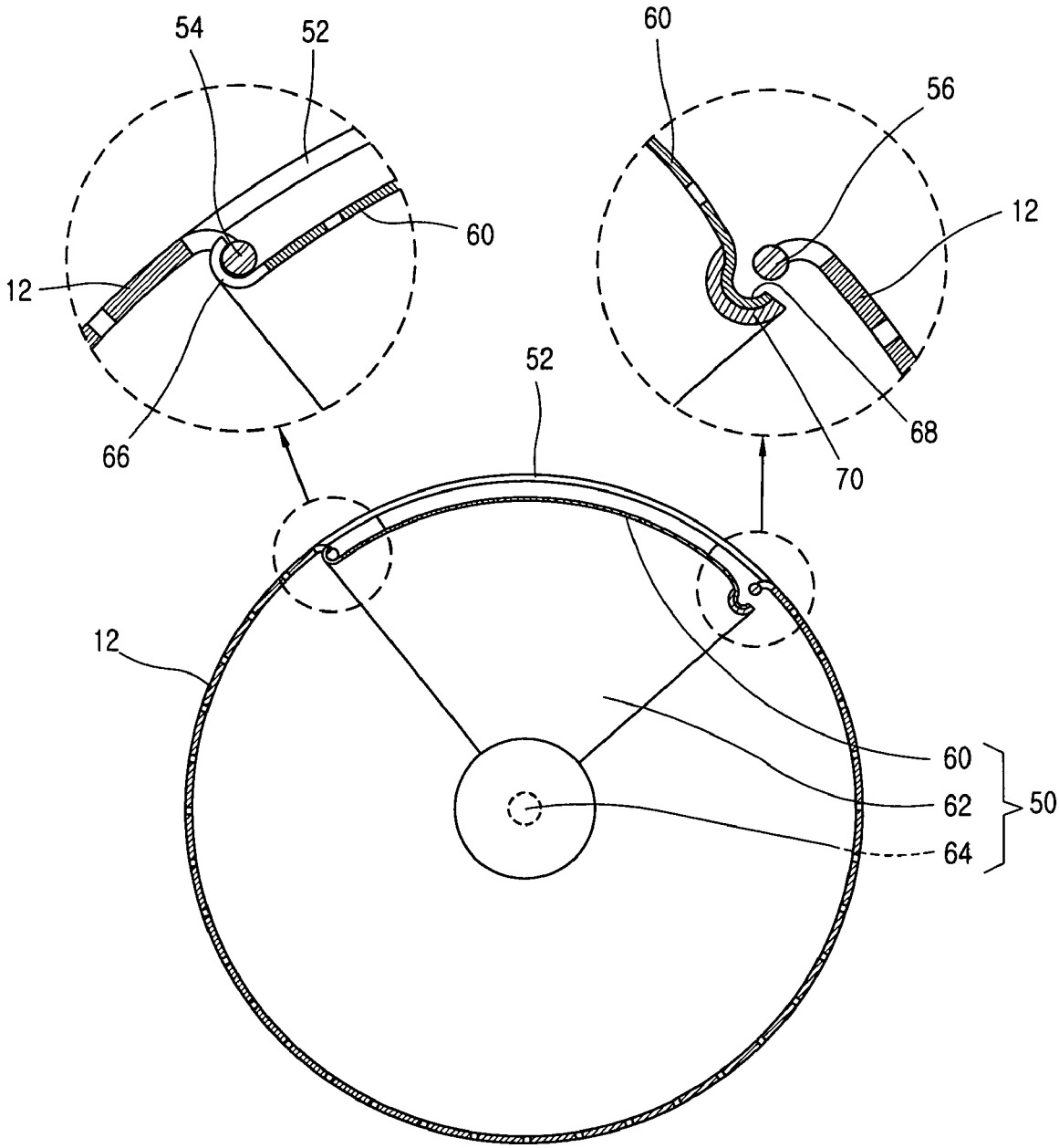
FIG. 11 is a cross-sectional view showing a status that a drum door of the drum type washing machine according to the third embodiment of the present invention is closed.
Figure 12:
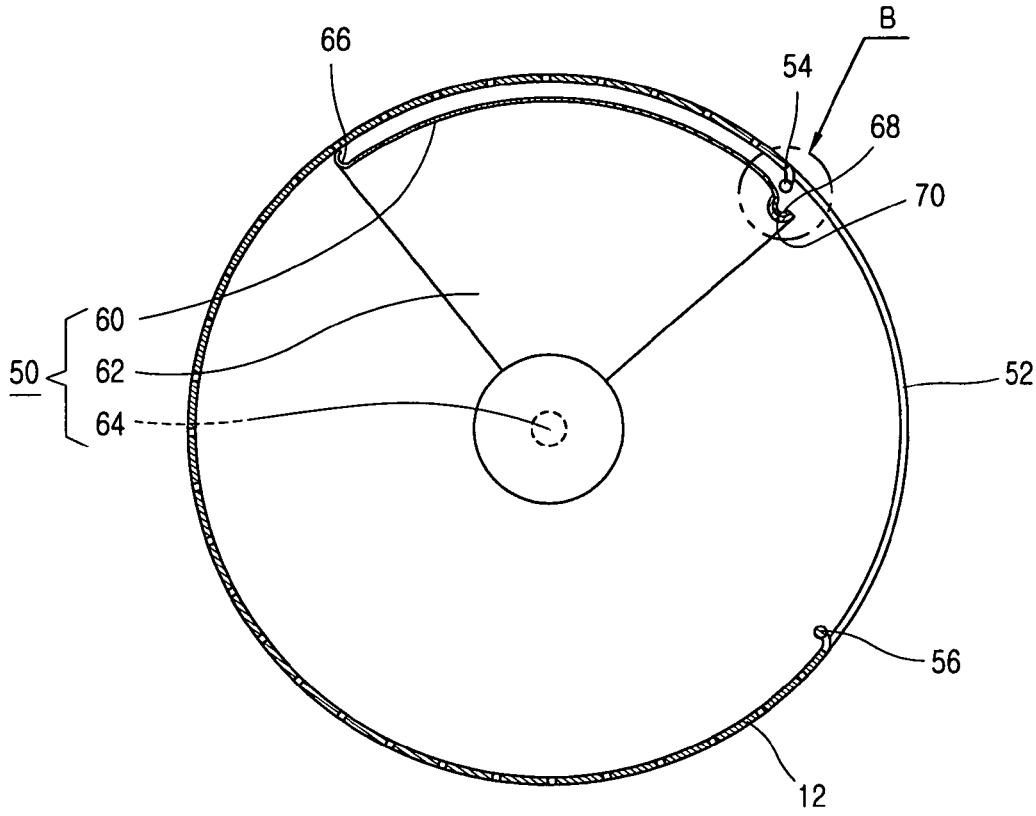
FIG. 12 is a cross-sectional view showing a status that a drum door of the drum type washing machine according to the third embodiment of the present invention is closed.

FIG. 11 is a cross-sectional view showing a status that the drum door of the drum type washing machine according to the third embodiment of the present invention is closed, and FIG. 12 is a cross-sectional view showing a status that the drum door of the drum type washing machine according to the third embodiment of the present invention is opened.

The drum door 50 comprises: a sealed portion 60 formed as an arc having same size as that of the drum inlet 52 for closing the drum inlet 52; connecting portions 62 extended from both end portions of the sealing portion 60 toward the center of the drum 12 as a sector form; and door hinge shafts mounted on end portions of the connecting portions 62 for supporting the drum door 50 to be rotatable.

A plurality of entrance holes 66 through which the washing water comes in/goes out are formed on the sealing portion 60. In addition, a suspending hook 66 for preventing the drum door 50 from moving more toward the closing direction by suspending on the suspending rod 54 of the door inlet 52 is formed on one end portion of the sealing portion 60, and a locking hook 68 for maintaining the closed status of the drum door 50 by being inserted into the locking rod 56 of the door inlet 52 is formed on the other end portion of the sealing portion 60.

Figure 13:
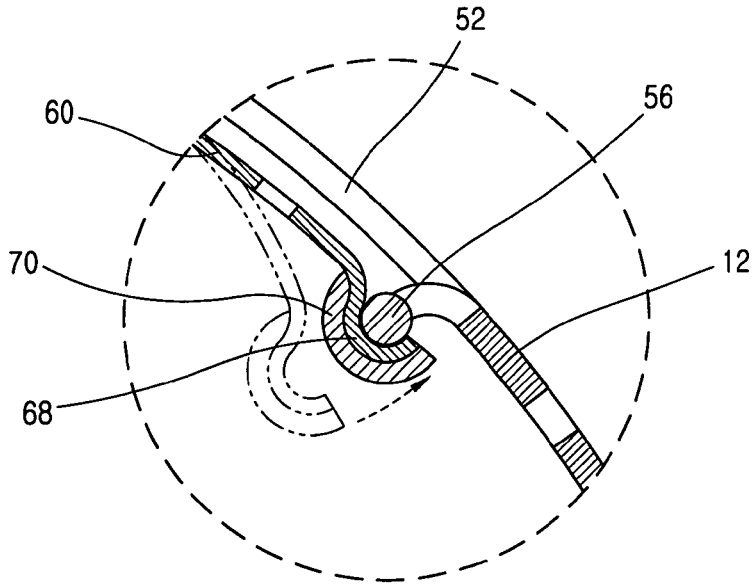
FIG. 13 is an enlarged view showing part B in FIG. 12.

As shown in FIG. 13, the locking hook 68 is formed on the end portion of the sealing portion 60 to be elastically transformed, and located as escaped from the locking rod 56, that is, located with a certain distance from the locking rod 56 when the drum 12 is in stopped status, not to interrupt the opening operation of the drum door 50.

In addition, a weighed body 70 having a predetermined weight is fixed on the locking hook 68 or integrally formed with the locking hook 68. Therefore, when the drum 12 is rotated, centrifugal force is applied to the weighed body 70, and accordingly, the locking hook 68 is elastically transformed and inserted in the locking rod 56 to lock the drum door 50.

The door hinge shafts 64 connected to the both sides of the drum door 50 are inserted in the penetrating holes 74 formed on the hinge shaft 19 and on the driving axis 21 supporting the drum 12 to be rotatable, and supported by them to be rotatable. In addition, the door opening/closing device for opening/closing the drum door 50 automatically is installed on the door hinge shaft 64 which is inserted in to the hinge shaft 19 supporting the drum 12.

Figure 14:
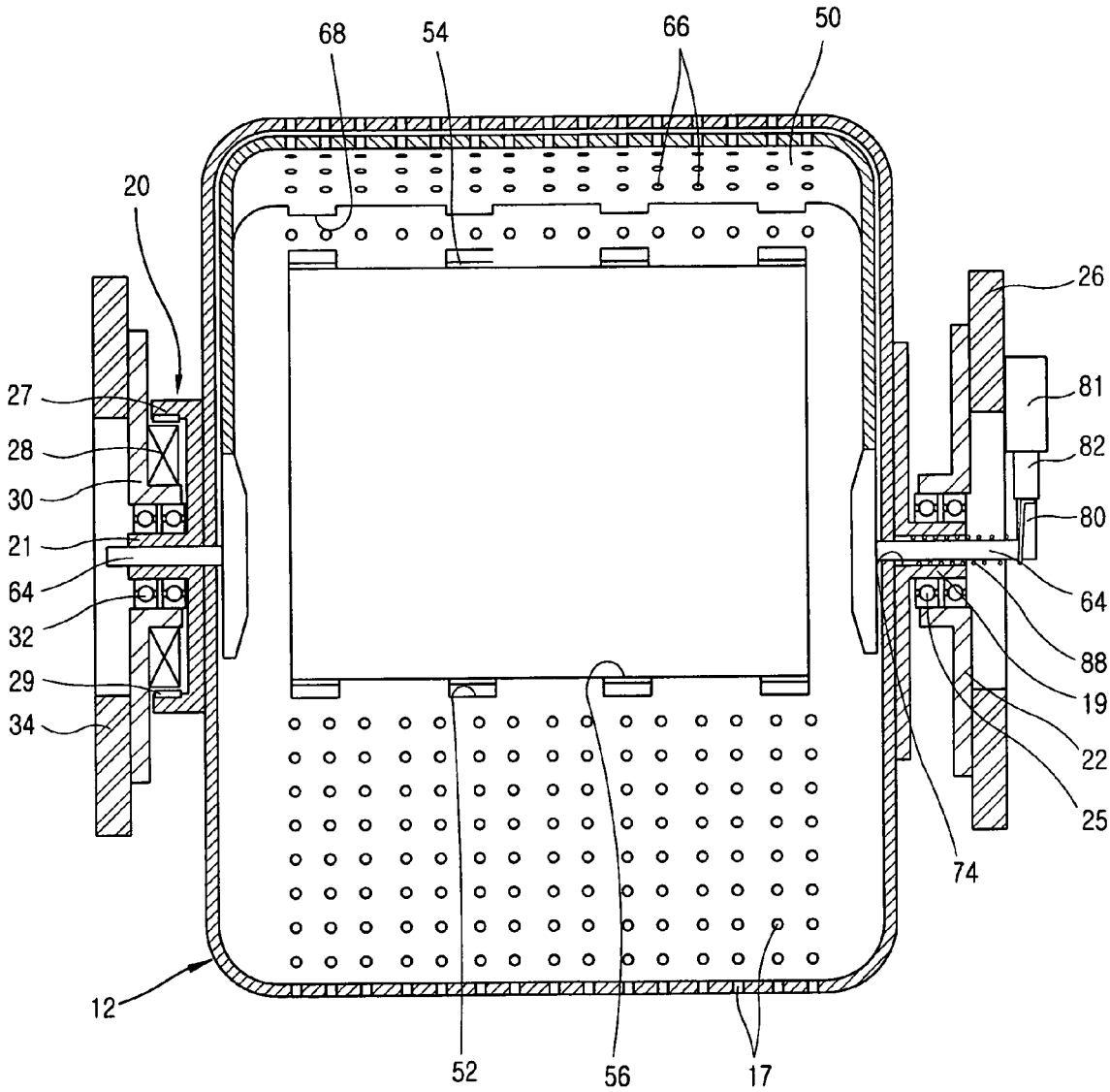
FIG. 14 is a cross-sectional view showing a door opening/closing device of the drum type washing machine according to the third embodiment of the present invention.
Figure 15:
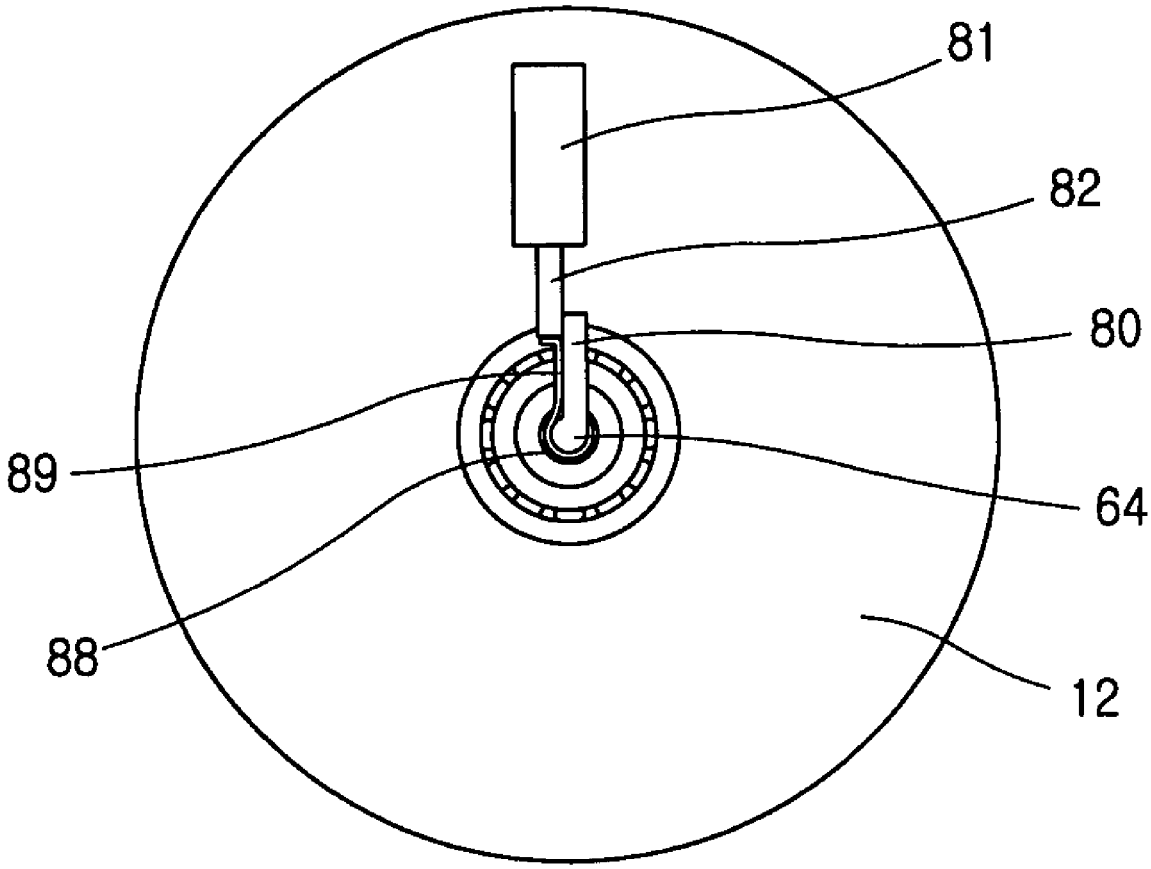
FIG. 15 is a rear view showing the door opening/closing device of the drum type washing machine according to the third embodiment of the present invention.
Figure 16:
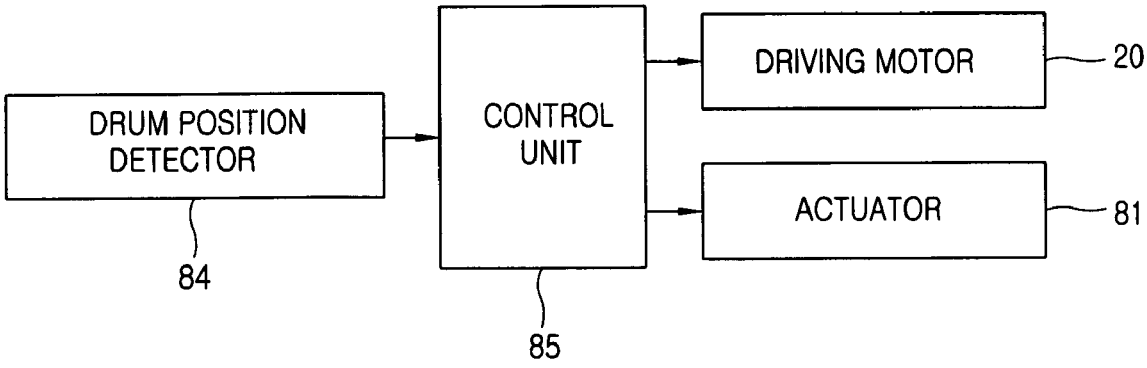
FIG. 16 is a block diagram showing a controlling means of the door opening/closing device of the drum type washing machine according to the third embodiment of the present invention.

FIG. 14 is a cross-sectional view showing the door opening/closing device according to the third embodiment of the present invention, and FIG. 15 is a rear view showing the door opening/closing device according to the third embodiment of the present invention, and FIG. 16 is a block diagram showing a controlling means of the door opening/closing device according to the third embodiment of the present invention.

As shown in FIG. 14, the door opening/closing device comprises: a suspending rod 80 extended integrally from the end portion of the door hinge shaft 64, an actuator 81 for restricting the rotation of the suspending rod 80, and a controlling means for controlling the actuator 81 or the drum 12 so as to open/close the drum door 50.

In addition, a backspin preventing means for preventing the drum door 50 from rotating toward the closing direction is installed on the door hinge shaft 64.

The suspending rod 80 is bent on the end portion of the door hinge shaft 64 as a right angle, and then, the rotation of the suspending rod 80 is restricted when the actuator 81 is operated.

A push rod 82 for restricting the rotation of the suspending rod 80 by contacting to the side surface of the suspending rod 80 is inserted into the actuator 81, and the actuator 81 is fixed on the rear surface of the first reinforcing plate 26. It is desirable that the actuator 81 is formed as a solenoid type which drives the push rod 82 as pushing it when the power source is applied.

As shown in FIG. 16, the controlling means comprises a drum position detector 84 for detecting the position of the drum 12, a driving motor 20 for driving the drum 12 after being applied a signal of the drum position detector 84, and a control unit 85 for operating the actuator 81.

Figure 17:
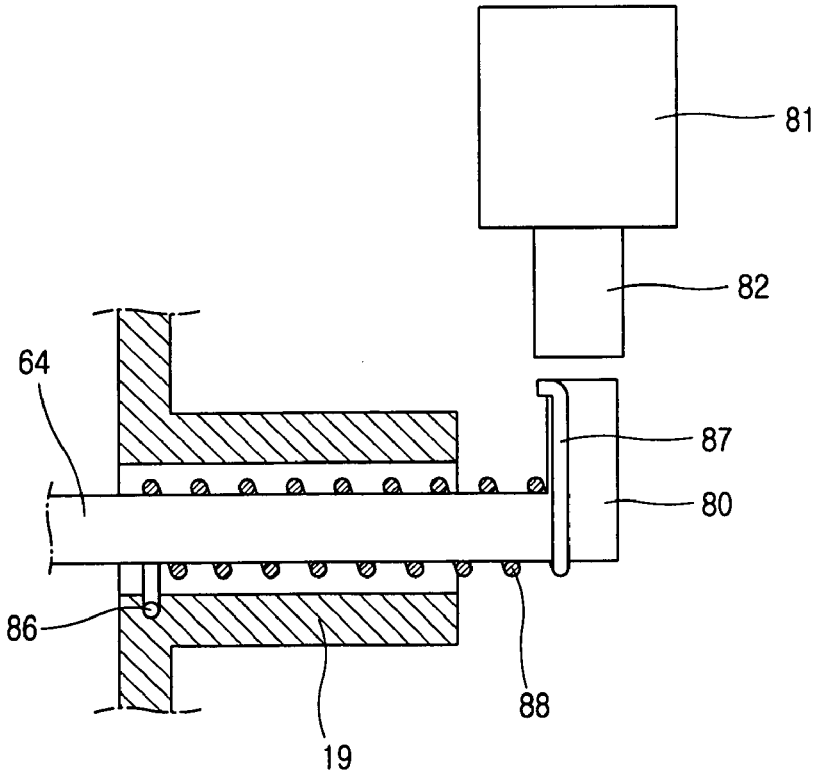
FIGS. 17 and 18 are partial cross-sectional views showing a door backspin preventing device of the drum type washing machine according to the third embodiment of the present invention.
Figure 18:
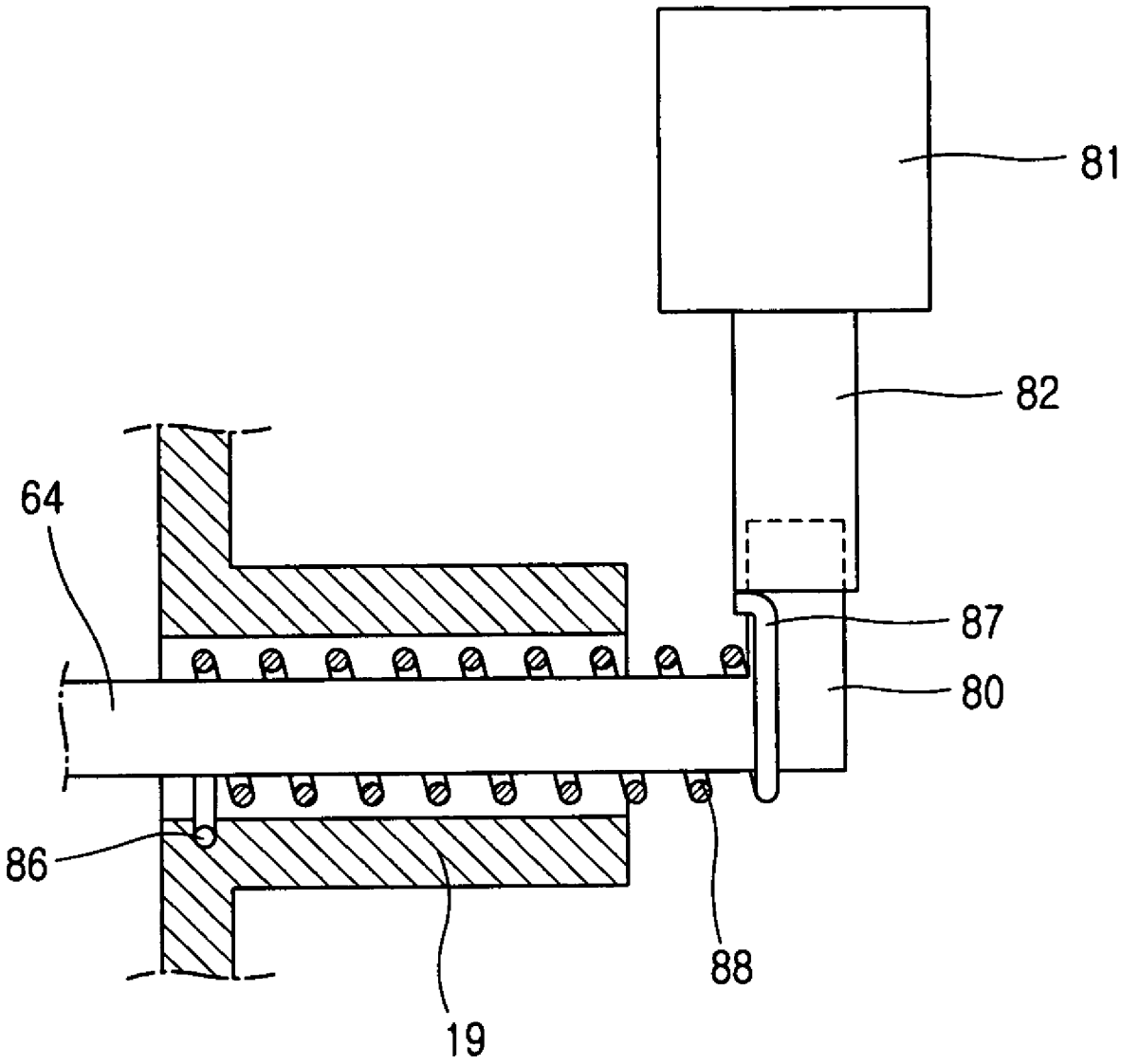

FIGS. 17 and 18 are cross-sectional views showing a backspin preventing means of the drum type washing machine according to the third embodiment of the present invention.

The backspin preventing means is a backspin preventing spring 88 having one end portion fixed on the hinge shaft 19 which is fixed on the drum 12 and the other end portion extended along with the suspending rod 80 to be a predetermined length and located to be face the front surface of the push rod 82 of the actuator 81.

As shown in FIG. 17, if the force is compressed toward the direction of opening the drum door 18 by the centrifugal force when the drum 12 is driven toward the reverse direction in washing and drying processes, the force is compressed toward the direction of winding the backspin preventing spring 88. Accordingly, the spring 88 is compressed on the outer circumferential surface of the door hinge shaft 64 to prevent the drum door 18 from being opened.

In addition, as shown in FIG. 18, when the push rod 82 pushes the end portion 87 of the spring 88 by the operation of the actuator 81, the spring 88 is released from the door hinge shaft 64 and the drum door 50 can be rotated freely.

The backspin preventing means may be a one-way clutch which is installed on the door hinge shaft 64 for preventing the drum door 18 from moving toward the opening direction.

Operations of the drum type washing machine constructed as above according to the third embodiment of the present invention will be described as follows.

When the laundries are put into the drum 12 through the drum inlet 52 as opening the cabinet door 14 and then the cabinet door 14 is closed and the power switch is turned on, the actuator 81 is operated according to the controlling signal of the control unit 85. Then, the push rod 82 is straightly moved to contact to the side surface of the suspending rod 80, and at the same time, to push the one end portion 87 of the backspin preventing spring 88. Therefore, the backspin preventing spring 88 is released from the door hinge shaft 64 to release the locked status of the drum door 50.

In above status, when the control unit 85 operates the driving motor 20, the drum 12 is rotated toward the direction of closing the drum door 50, and then, the drum door 50 is closed on the drum inlet 52.

At that time, the suspending hook 66 of the drum door 50 is coupled to the suspending rod 80 installed on one side of the drum inlet 52 to prevent the drum door 50 from moving more than the status that the drum door 50 closes the drum inlet 52.

In addition, the washing and drying operations are performed as the drum 12 is rotated by the normal operation of the driving motor 20. At that time, the locking hook 68 of the drum door 50 is elastically transformed by the centrifugal force of the drum 12, and then, inserted into the locking rod 56 installed on the drum inlet 52 to maintain the status that the drum door 40 is closed on the drum inlet 52.

That is, when the centrifugal force is applied by the weight of the weighed body 70 fixed on the locking hook 68, the locking hook 68 is inserted into the locking rod 56 while elastically transformed.

In addition, when the drum 12 is rotated toward the direction of opening the drum door 50 in the washing and drying operations, the backspin preventing spring 88 is operated to prevent the drum door 50 from being opened. That is, when the drum 12 is rotated toward the direction of opening the drum door 40, the backspin preventing spring 88 compresses the outer circumferential surface of the door hinge shaft 64 to prevent the drum door 50 from being opened.

After a predetermined time passes and the washing and drying operations are completed, the drum 12 is stopped at the set position, and the opening operation of the drum door 50 is performed and the laundries are drawn from the drum 12.

That is, the control unit 85 controls the driving motor 20 according to the signal applied from the drum position detector 84 so that the drum 12 can be stopped at the set position, and drives the actuator 81. Then, the push rod 82 is straightly moved and contacted to the side surface of the suspending rod 80 to restrict the drum door 50 not to rotate. In above status, the control unit 85 operates the driving motor 20 again to rotate the drum 12, and thereby, the drum inlet 52 is opened from the drum door 50.

Effects of the drum type washing machine constructed and operated as above will be described as follows.

According to the drum type washing machine of the present invention, the tub is fixed inside the cabinet, and therefore, the size of the drum can be maximized. Therefore, the washing capacity of the drum can be increased without increasing the size of the cabinet. Also, the installation space of the driving motor can be minimized by fixing the rotor of the driving motor onto the drum directly, and therefore, the washing capacity can be increased and the entire size of the washing machine can be compacted.

Also, since the hinge shaft and the driving axis are fixed on center portions of the both sides of the drum and supported to be rotatable, the drum can be rotated stably in the washing and drying operations.

Also, the drum door opens/closes the drum inlet formed on the circumferential surface of the drum automatically, and thereby, the convenience in usage can be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A drum type washing machine comprising:

a cabinet forming an outer appearance;

a tub for storing washing water, the tub being supported from the cabinet and having penetrating holes at both sides;

a drum disposed in the tub having both side surfaces supported inside the cabinet rotatably and separately from the supporting of the tub and an inlet through which laundries can be loaded and unloaded from a circumferential surface thereof;

a drum door installed on the drum inlet for opening/closing the drum inlet;

a door opening/closing device for opening/closing the drum door automatically;

a first supporting frame placed at one of the penetrating holes;

a second supporting frame placed at another of the penetrating holes; and gaskets connected between circumferences of the penetrating holes and the supporting frames, respectively.

2. The washing machine of claim 1, wherein the drum door comprises:

a sealing portion formed as an arc having a same size as that of the drum inlet for opening/closing the drum inlet;

a connecting portion extended from both end portions of the sealing portion toward a center of the drum as a sector form; and door hinge shafts mounted on an end portion of the connecting portion for supporting the drum door to be rotatable.

3. The washing machine of claim 2, wherein a plurality of entrance holes through which the washing water comes in/goes out are formed on the sealing portion, and a locking device for locking a closed drum door is mounted between the sealing portion and the drum inlet.

4. The washing machine of claim 2, wherein the door comprises:

a suspending rod connected to an end portion of the door hinge shaft;

an actuator mounted on one side of the suspending rod for restricting the rotation of the suspending rod; and a controlling means for opening/closing the drum door by driving the actuator and rotating the drum.

5. The washing machine of claim 1, further comprising a driving motor to rotate the drum, and wherein the driving motor is directly connected to the drum.

6. The washing machine of claim 1, wherein the tub is formed as a cylinder having a front portion integrally formed on a front inner wall of the cabinet and a rear portion.

7. The washing machine of claim 1, wherein the tub comprises:

a first separating wall portion integrally fixed between an upper front inner wall of the cabinet and a rear inner wall of the cabinet; and a second separating wall portion fixed integrally on a lower front wall and a rear inner wall of the cabinet and formed as a curved plate.

8. The washing machine of claim 1, wherein the supporting frames rotatably support the drum at both sides.

9. The washing machine of claim 1, further comprising a driving motor, wherein a rotor of the motor is mounted on the drum and a stator if the motor is mounted on the second supporting frame.

10. The washing machine of claim 9, wherein the rotor is arranged around a stator.

11. The washing machine of claim 1, further comprising suspensions to support the supporting frames from the cabinet.

12. The washing machine of claim 11, wherein each respective suspension comprises a spring or a damper.

* * * * *